United States Patent [19]

Jordal

[11] Patent Number: 4,813,183

[45] Date of Patent: Mar. 21, 1989

[54] DUAL LOUVER BLADE JALOUSIE WINDOW

[76] Inventor: Robert L. Jordal, Rte. 10, Box 351, Winston-Salem, N.C. 27127

[21] Appl. No.: 94,126

[22] Filed: Sep. 8, 1987

[51] Int. Cl.[4] ..... E06B 7/08

[52] U.S. Cl. ..... 49/74; 49/82; 49/91

[58] Field of Search ..... 49/77, 64, 82, 91, 74; 98/121.2

[56] References Cited

U.S. PATENT DOCUMENTS

| | | | |
|---|---|---|---|
| 857,642 | 6/1907 | Lorenz | 49/64 |
| 2,867,861 | 1/1959 | Pilson | 49/77 X |
| 3,110,937 | 11/1963 | Naslund | 49/77 X |
| 3,123,098 | 3/1964 | Bishop | 98/121.2 X |
| 3,159,909 | 12/1964 | Pappas | 49/91 X |
| 3,350,814 | 11/1967 | Dufrene | 49/82 |
| 4,493,342 | 1/1985 | Bachmann | 49/77 X |

FOREIGN PATENT DOCUMENTS

| | | | |
|---|---|---|---|
| 574878 | 4/1959 | Canada | 49/91 |

*Primary Examiner*—Philip C. Kannan

[57] ABSTRACT

Jalousie apparatus is presented whereby a pair of louver blades are affixed one behind the other to a rotatable shaft for opening and closing the blades in unison. Spacers are positioned between the shaft and the louver blades having apertures which allow pressure equalization between succeeding tiers of blade pairs when columns of pairs of blades are utilized. The jalousie apparatus provides a window which forms a sealed air chamber with the louver blades closed which is highly resistant to air and water infiltration and which has a high insulation value.

14 Claims, 4 Drawing Sheets

DUAL LOUVER BLADE JALOUSIE WINDOW

BACKGROUND OF THE INVENTION

1. Field of the Invention

The present invention relates to building windows and doors and particularly to jalousie type windows which are adjustably controllable to allow the desired airflow into the building.

2. Description Of The Prior Art And Objectives Of The Invention

Windows and doors with jalousie constructions have long been employed and are desirable in geographical areas such as the tropics where air conditioning may be impractical or unaffordable and where maximum airflow through the building is desired as jalousie windows provide for approximately 100% ventilation. Though jalousie type windows have certain advantages over conventional windows, certain disadvantages are also apparent such as their inability to tightly seal under adverse weather conditions and their low insulation values. In the past also windows have been constructed having front and rear louver blades which were independently operated and which did not provide adequate insulation values or operate in unison.

Thus, with known disadvantages to conventional jalousie type windows, the present invention was conceived and one of its objectives is to provide a jalousie window having a pair of louver blades mounted on either side of a rotatable shaft with one blade in front of the other and having improved structural integrity and load bearing capabilities which seals tightly upon closing to provide a high insulation value.

It is another objective of the present invention to provide a jalousie window which is relatively easy to construct and which will provide years of trouble-free operation.

It is still another objective of the present invention to provide a dual blade jalousie window which provides pressure equalization slots between tiers of blade pairs for maximum performance and with the use of tempered glass or polycarbonate front louver blades, a vandal resistant structure is provided.

It is yet another objective of the present invention to provide a dual blade jalousie window which is easy to operate and upon closing affords maximum insulation values by forming a sealed air chamber between the front and back louver blades which is resistant to air and water infiltration during adverse weather conditions.

Various other objectives of the present invention will become apparent to those skilled in the art as a review is made of the details of the invention set forth below.

SUMMARY OF THE INVENTION

The aforesaid and other objectives of the invention are met by jalousie apparatus having a rotatable shaft to which is spatially affixed a pair of louver blades. Multiple tiers and columns of jalousies can be constructed depending on the size of the window area opening needed. For example, a small room may require a jalousie window having only four (4) pairs of louver blades, while a door may require ten (10) pairs of blades, and an office front may require a much larger window with non-moving panes flanked by dual louver blade jalousies. The closed jalousie apparatus of the invention forms a weather tight, dual pane window which due to the seals around the louver blades, forms a superior barrier over conventional single pane jalousies having improved structural loading of 1.5 times single pane structures.

DESCRIPTION OF THE PREFERRED EMBODIMENT

Figure 2:
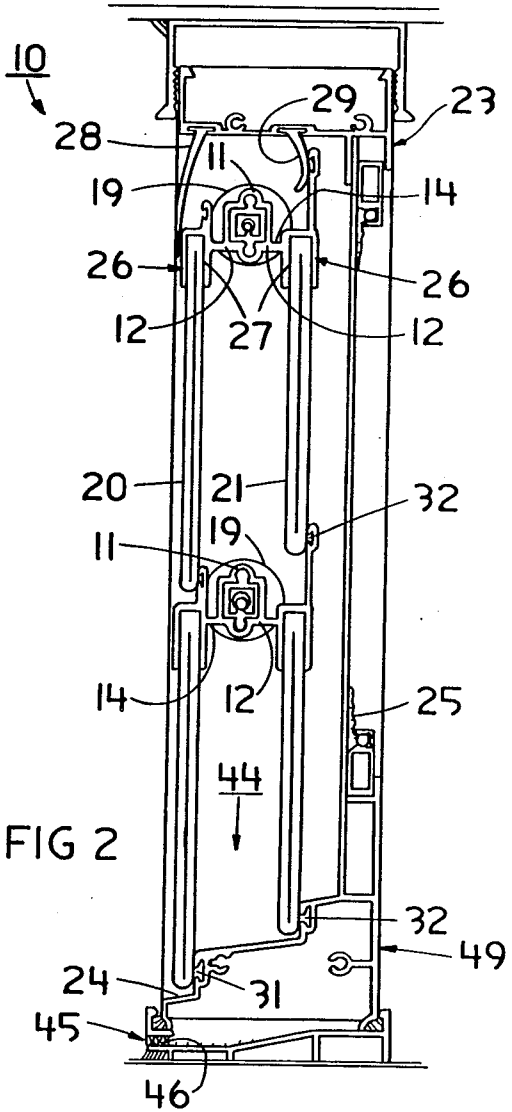
FIG. 2 depicts an enlarged open end view of a two (2) tier dual louver blade jalousie.

The preferred form of the invention is shown in FIG. 2 in which each tier comprises a pair of louver blades tandemly mounted to a rotatable shaft. The shaft is connected to a spacer with an integrally formed blade channel. Apertures are present in the gutter formed by the surface of the spacers to equalize pressure when closed between succeeding tiers in a column when closed to allow any moisture between the blades of a tier to escape downwardly and air to pass therethrough. The front blade as shown in FIG. 2 is wider than the rear blade to insure a sufficient airflow when open and to allow the rear blade to clear the shaft, upon rotation.

DETAILED DESCRIPTION OF THE DRAWINGS AND OPERATION OF THE INVENTION

Figure 1:
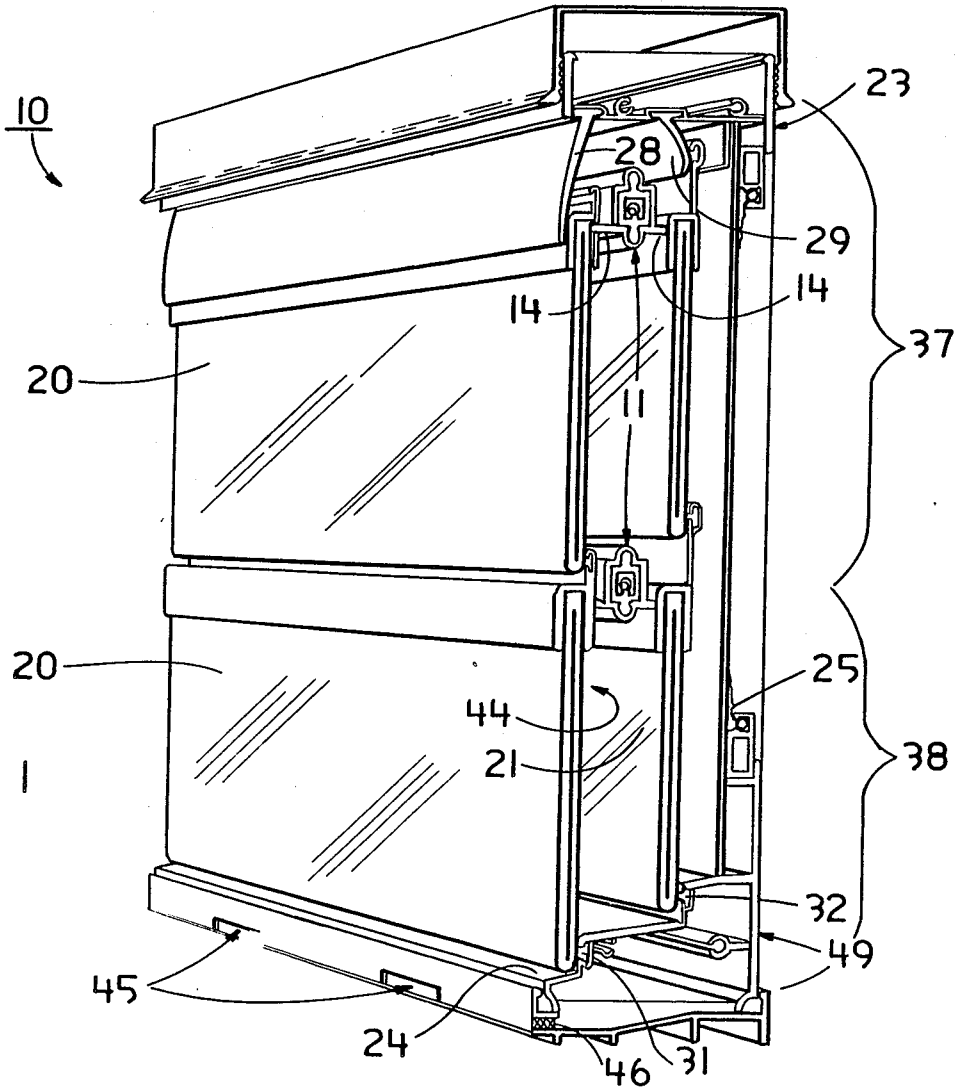
FIG. 1 demonstrates in partial, cut-away fashion a window configuration in which two (2) tiers of dual blade jalousies are shown.

Turning now to the drawings, a perspective view of a typical jalousie window 10 is shown in FIG. 1 having tiers 37 and 38. Each tier includes a rotatable shaft 11, a front louver blade 20 and a rear louver blade 21. Blades 20 and 21 each may be glass, wood, plastic, aluminum or other suitable materials as desired. For example, a front blade of tempered glass or polycarbonate may be used for a more vandal or hurricane resistant construction. Thus, jalousie window 10 as shown in FIG. 1 comprises a single column two-tier configuration with each tier having dual louver blades, with front blade 20 measuring for example, 30 inches in length, 6 inches in height and ¼ inch in thickness with 1 ¼ inch spacing between the front and back blades. Other jalousie configurations or arrangements can be made. For example in FIG. 4, a bank of windows having two (2) columns of jalousies separated by a center column with immovable glass panes 35 is seen.

Figure 5:
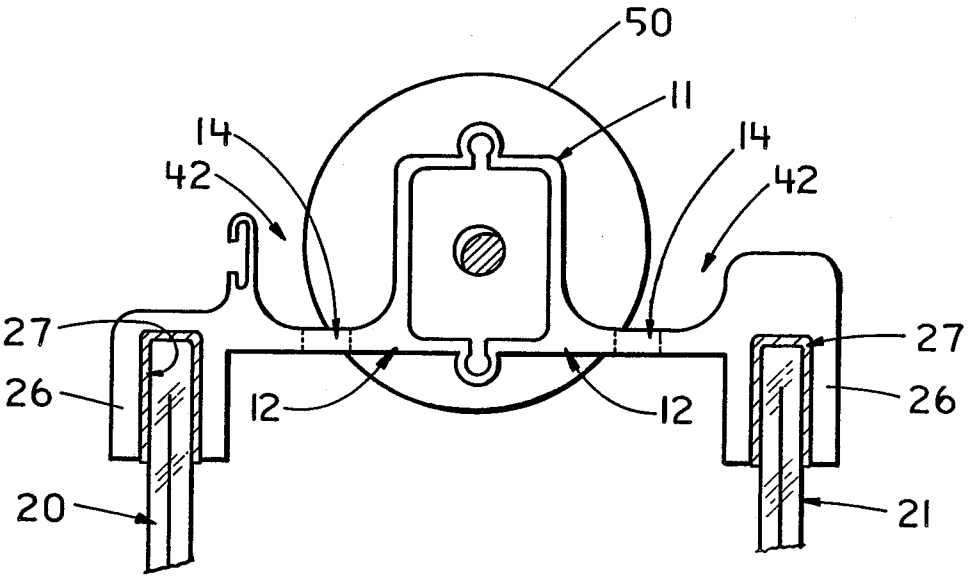
FIG. 5 shows an enlarged partial end view of a single pair of blades configured to operate in unison.

The operation of the dual blade jalousie window 10 is understood by viewing the illustrations as shown in FIGS. 2 and 5. Front louver blade 20 made from clear glass is attached to rotatable shaft 11 as is rear glass louver blade 21. Rear louver blade 21 is somewhat narrower (FIG. 2) than front louver blade 20 to clear shaft 11 below upon rotation or opening of window 10 in which blades 20 and 21 move in a clockwise direction as would be understood from FIG. 2. Blade 20 is affixed in blade channel 26 with blade channel seal 27 which consists of a vinyl or rubber or other gasket material as conventionally used. Blade channel 26 is integrally formed with spacer means 12 and rotatable shaft 11 as, for example, being formed as an aluminum extrusion. Spacer means 12 defines a gutter 42 with apertures or slots 14 therein, said apertures 14 may consist of a pair of slots between each blade pair (FIG. 5).

Figure 3:
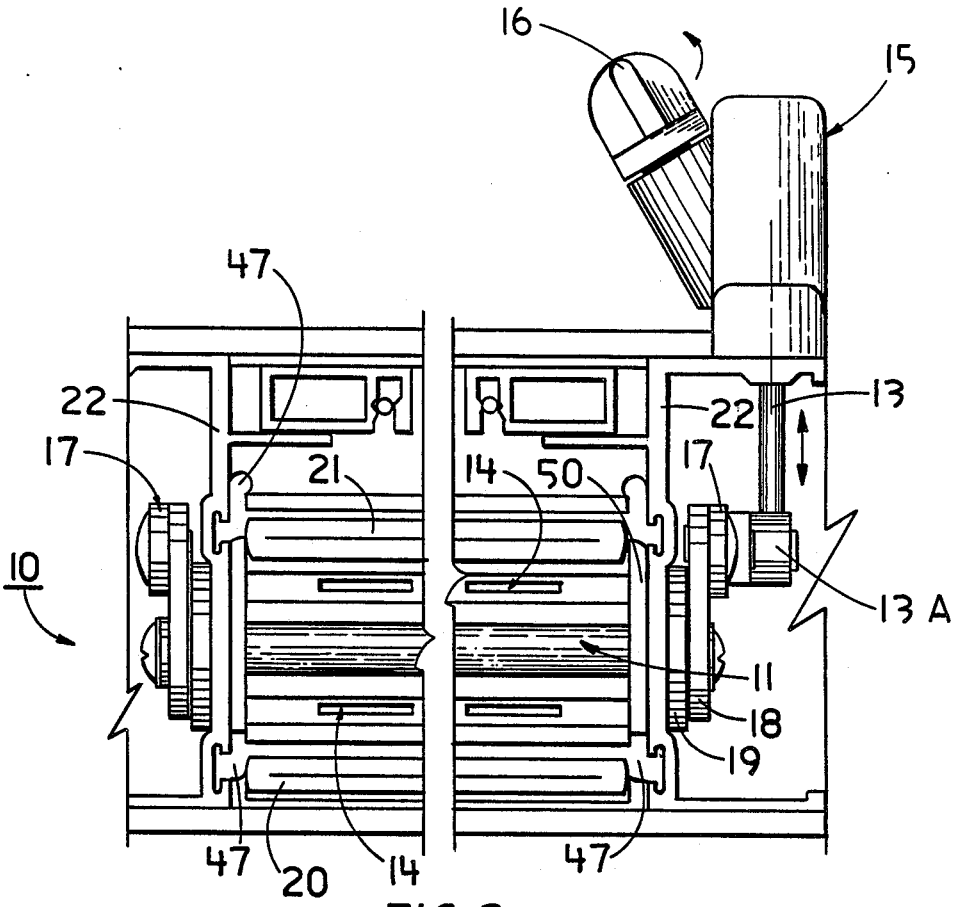
FIG. 3 shows in abbreviated fashion a open top view demonstrating certain mechanical operating components.

Jalousie frame head 23 is shown in FIG. 2 with front seal 28 and rear seal 29 which assits in preventing leaks by window 10 during rain or other adverse weather conditions. Screen 25 is contained by frame 49 as is conventional in the art to prevent insects and small debris from entering window 10 when blades 20 and 21 are rotated outwardly. Screen 25 can be replaced with a glass or solid panel to provide additional insulation to window 10 during cold or winter conditions if needed. Front sill seal 31 and rear seal 32 are included to insure a tight closure of front louver blade 20 and rear louver blade 21 in the closed posture as seen in FIG. 2 along with jamb seals 47 as seen in FIG. 3. Sill 24 is sloped downwardly from the rear to the front to insure any moisture therebetween is drained forwardly and out. Also, as seen in FIG. 1 rectangular openings 45 allow any water under sill 24 to drain from thereunder. An open cell foam material 46 is behind opening 45 as seen in FIG. 2.

Figure 6:
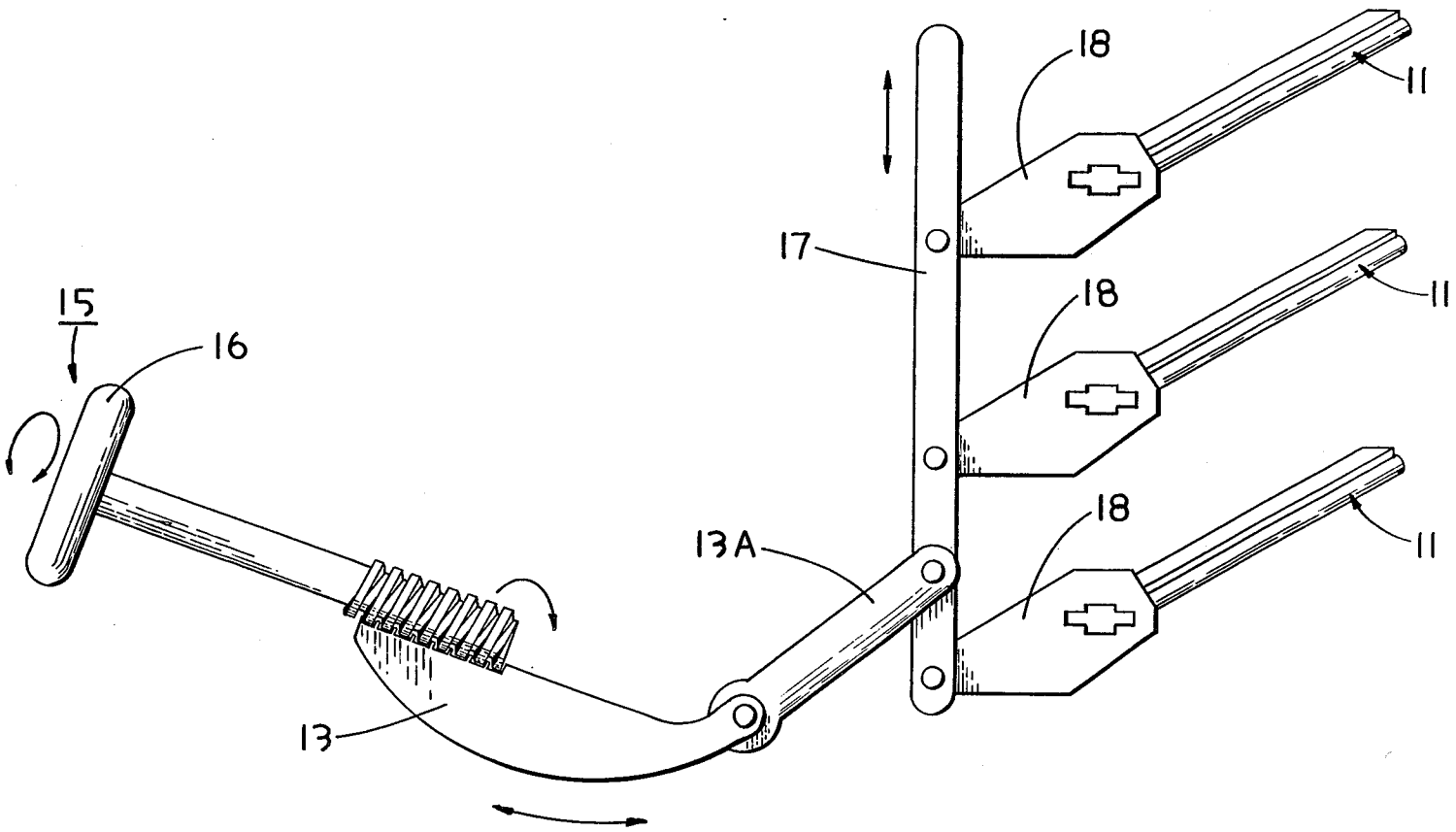
FIG. 6 demonstrates a schematic view of the mechanical operator.

Operator means 15 which is depicted schematically in FIG. 6 includes handle 16 having a worm gear portion, operator sector gear 13, operator drive link 13A, slide bar 17 and pivot arm 18 as conventionally used with jalousie type windows. As would be understood, handle 16 can be rotated as desired causing operator sector gear 13 to move inwardly or outwardly thereby directing drive link 13A respectively raising or lowering slide bar 17 to thereby turn pivot arm 18 affixed to shaft 11 which in turn causes shaft 11 to pivot. Other types of operator means can be also be used to rotate shaft 11 and operator means 15 merely illustrates a conventional mechanism which is simple, efficient and relatively trouble free.

Figure 4:
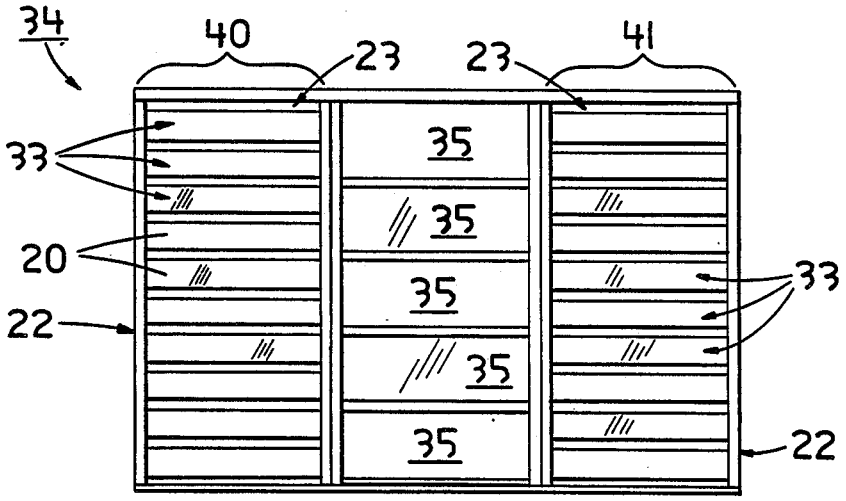
FIG. 4 illustrates a typical jalousie bank installation.

As further seen in FIG. 3, slide bar 17 may be attached to one pivot arm 18 or may be affixed to several pivot arms 18 in a column of tiers, with each pivot arm 18 being joined to a rotatable shaft 11. For example, in FIG. 4 one slide bar may be affixed to ten (10) rotatable shafts (pivot arms) in order for all ten pairs 33 of blades to operate in unison. Panes 35 in FIG. 4 are conventional and stationary. As further demonstrated, two (2) handles 16 (not shown in FIG. 4) would be required to operate louver blade pairs 33 in FIG. 4 as one handle would operate left column 40 and the second handle would operate right column 41. When closed, columns 40 and 41 provide a tight seal against air and moisture infiltration and form a closed chamber and due to the dual blade configuration, the structural integrity and insulation values greatly surpasses conventional single blade jalousie constructions.

While multiple pane windows have been conventionally commercialized heretofore, multiple tandem louver panes (blades) which operate in unison have been unknown in jalousie type windows due to the required rotation. The opening of window 10 as shown in FIG. 2 is accomplished by providing a rotatable shaft 11 with dual spacer means 12 affixed thereto whereby front louver blade 20 and rear louver blade 21 rotate in unison as shaft 11 turns with nylon pivot bearing 50 which is sized to insert in the end of rotatable shaft 11. Bearing cap 19 is attached to pivot arm 18 and is inserted in bearing 50 (FIG. 3).

In adverse weather conditions such as violent thunderstorms or the like where high winds are present, jalousie type windows are conventionally known to undergo slight blade deformation thereby creating seal failure and leakage problems. The dual blade construction of the present invention with outer frame 49 comprising jalousie frame head 23, jambs 22 and sill 24 and sealing means thereon including louver blade seals 31, 32 and jamb seals 47 provides a window with high structural integrity and when closed forms an air chamber 44 between the front and rear louver blades having a high insulation value, as shown in FIGS. 1 and 2.

Pressure equalization is obtained along the entire column, regardless of the number of tiers, due to spacer means apertures 14 positioned in gutter 42 as seen in FIG. 2. Apertures or slots 14, while equalizing the pressure along the entire vertical length of the window by allowing free air flow between louver blades 20 and 21, also allows condensate or moisture drainage thereby assisting in preventing bearing or other component damage or failure which may occur with water flowing between bearing 50 and shaft 11. Moisture draining downwardly to the top of sill 24 through aperture 14 will create sufficient moisture accumulation until front seal 31 deforms and moisture thereagainst will pass under front blade 20 and between seal 31 and blade 20 and will thereby escape. Any water that might trickle down along the inside of window jamb 22 as seen in FIG. 3 and accumulate under sill 24 can drain out through opening 45 (FIG. 1). Along the sides of jalousie apparatus 10 as seen in FIG. 3 are seals 47 which provide a tight seal against the weather when louver blades 20, 21 are closed. Seals 47 are constructed of vinyl, rubber or other suitable materials.

Thus as shown and described the dual louver blade construction will withstand adverse weather conditions and will also benefit the user due to its insulating value when closed.

Changes and modifications can be made to the invention as shown herein and the illustrations and examples are merely for explanatory purposes and are not intended to limit the scope of the appended claims.

I claim:

1. Jalousie apparatus comprising: a rotatable shaft, a pair of spacer means, said spacer means joined to said shaft, each of said spacer means defining a gutter, a pair of louver blades, each of said blades mounted to one of said spacer means, operator means, said operator means joined to said shaft for rotating said shaft to thereby turn said pair of louver blades in unison.

2. Jalousie apparatus as claimed in claim 1 wherein said operator means includes a handle, an operator sector gear, said sector gear movably attached to said handle, a drive link, said link pivotally attached to said sector gear, a slide bar, said drive link pivotally joined to said bar, a pivot arm, said pivot arm attached to said shaft and to said bar whereby turning said handle causes said pair of blades to rotate in unison.

3. Jalousie apparatus as claimed in claim 1 wherein said spacer means defines an aperture.

4. Jalousie apparatus as claimed in claim 1 comprising a column of pairs of louver blades.

5. Jalousie apparatus comprising: a rotatable shaft, a pair of spacer means, said spacer means joined to said shaft, each of said spacer means defining a gutter having an aperture therein, a pair of louver blades, said blades mounted one behind the other, each of said blades mounted to one of each of said spacer means with said apertures positioned between said blade and said shaft, operator means, said operator means connected to said shaft for rotating said shaft whereby turning said operator means causes said blades to rotate in unison.

6. Jalousie apparatus as claimed in claim 5 wherein each of said pair of louver blades are of a different width.

7. Jalousie apparatus as claimed in claim 6 comprising a bank of columns of pairs of louver blades.

8. Jalousie apparatus comprising: a frame, said frame including a jamb frame head, a pair of jambs, said jambs attached to said frame head, a sill, said sill affixed to said pair of jambs, a rotatable shaft, said shaft pivotally attached to said frame, a pair of louver blades, spacer means, sides spacer means affixed to said shaft on opposite sides thereof, said spacer means defining a gutter, and operator means, said operator means joined to said shaft to rotate said louver blades from a closed to an open position.

9. Jalousie apparatus as claimed in claim 8 wherein said spacer means is joined to said shaft on each side thereof, and said spacer means defining an aperture.

10. Jalousie apparatus as claimed in claim 8 and including sealing means, said sealing means positioned on said frame to prohibit air infiltration around said louver blades when said blades are in the closed position.

11. Jalousie apparatus as claimed in claim 8 when said louver blades form a sealed air chamber between said blades when in the closed position.

12. Jalousie apparatus comprising: a rotatable shaft, a pair of spacer means, said spacer means rigidly joined on opposite sides to said shaft, a pair of louver blades, said louver blades mounted each to one of said spacer means with said shaft positioned between said louver blades whereby rotation of said shaft will cause said pair of louver blades to rotate in unison.

13. Jalousie apparatus as claimed in claim 12 wherein said louver blades are mounted in parallel.

14. Jalousie apparatus as claimed in claim 12 wherein each of said spacer means include a blade channel

* * * * *